US010408035B2

(12) United States Patent
Kennedy et al.

(10) Patent No.: US 10,408,035 B2
(45) Date of Patent: Sep. 10, 2019

(54) DOWNHOLE PUMPING SYSTEMS AND INTAKES FOR SAME

(71) Applicant: EOG Resources, Inc., Houston, TX (US)

(72) Inventors: Steven C. Kennedy, Azle, TX (US); Brian Hill, Midland, TX (US)

(73) Assignee: EOG RESOURCES, INC., Houston, TX (US)

( * ) Notice: Subject to any disclaimer, the term of this patent is extended or adjusted under 35 U.S.C. 154(b) by 60 days.

(21) Appl. No.: 15/722,842

(22) Filed: Oct. 2, 2017

(65) Prior Publication Data

US 2018/0094515 A1 Apr. 5, 2018

Related U.S. Application Data

(60) Provisional application No. 62/403,417, filed on Oct. 3, 2016.

(51) Int. Cl.

| | |
|---|---|
| ***E21B 17/18*** | (2006.01) |
| ***E21B 43/12*** | (2006.01) |
| ***E21B 43/38*** | (2006.01) |
| ***F04D 29/42*** | (2006.01) |
| ***F04D 13/10*** | (2006.01) |
| *F04D 13/08* | (2006.01) |

(52) U.S. Cl.

CPC ..... *E21B 43/38* (2013.01); *E21B 17/18* (2013.01); *E21B 43/121* (2013.01); *E21B 43/128* (2013.01); *F04D 13/10* (2013.01); *F04D 29/4293* (2013.01); *F04D 13/08* (2013.01)

(58) Field of Classification Search

CPC ..... F04B 47/06; F04D 13/10; E21B 43/38; E21B 17/18; E21B 43/121; E21B 43/128

See application file for complete search history.

(56) References Cited

U.S. PATENT DOCUMENTS 4,762,176 A 8/1988 Miller
4,977,958 A * 12/1990 Miller ..... E21B 34/12 166/205

(Continued)

FOREIGN PATENT DOCUMENTS

WO 2009/079363 A2 6/2009

*Primary Examiner* — David J Bagnell
*Assistant Examiner* — Brandon M Duck
(74) *Attorney, Agent, or Firm* — Conley Rose, P.C.

(57) ABSTRACT

An intake for a downhole pump includes an outer tubular member having a central axis. In addition, the intake includes an inner tubular member disposed within the outer tubular member. The inner tubular member is radially spaced from the outer tubular member to form an outer annular flow path radially positioned between the inner tubular member and the outer tubular member. Further, the intake includes a central shaft rotatably disposed within the inner tubular member. The central shaft is radially spaced from the inner tubular member to form an inner annular flow path radially positioned between the central shaft and the inner tubular member. Still further, the intake includes a plurality of inlet apertures extending radially through the outer tubular member and in fluid communication with the outer annular flow path. Each of the plurality of inlet apertures has a circumferential width W between 5% and 50% of a total circumference of the outer tubular member.

18 Claims, 5 Drawing Sheets

(56) References Cited

U.S. PATENT DOCUMENTS

| | | | | |
|---|---|---|---|---|
| 5,653,286 | A | 8/1997 | McCoy et al. | |
| 6,702,028 | B1 * | 3/2004 | Heggholmen | E21B 43/121 166/105.5 |
| 8,079,418 | B2 | 12/2011 | Brown et al. | |
| 9,909,402 | B2 * | 3/2018 | Armistead | E21B 36/00 |
| 2007/0051509 | A1 * | 3/2007 | Selph | E21B 43/128 166/105 |
| 2009/0065202 | A1 | 3/2009 | Brown et al. | |
| 2014/0332219 | A1 * | 11/2014 | Bassett | E21B 43/162 166/306 |
| 2016/0130923 | A1 * | 5/2016 | Nowitzki | F04D 13/10 166/66.4 |
| 2018/0223642 | A1 * | 8/2018 | Zahran | E21B 43/34 |

* cited by examiner

DOWNHOLE PUMPING SYSTEMS AND INTAKES FOR SAME

CROSS-REFERENCE TO RELATED APPLICATIONS

The present application claims the benefit of U.S. Provisional Application No. 62/403,417, filed Oct. 3, 2016, entitled "Downhole Pumping Systems and Intakes for Same," which is incorporated by reference in its entirety for all purposes.

STATEMENT REGARDING FEDERALLY SPONSORED RESEARCH OR DEVELOPMENT

Not applicable.

BACKGROUND

The disclosure relates generally to downhole pumping systems and methods for lifting fluids from subterranean boreholes. More particularly, the disclosure relates to fluid intakes for downhole pumps used to lift fluids to the surface.

When producing hydrocarbons from a subterranean well, it is often necessary or at least desirable to install a pump (or multiple pumps) that lift fluids from the well to the surface. In many wells, the fluids that migrate into the well from the surrounding reservoir are multiphase or mixed phase, meaning the fluids include both gases and liquids. Such mixed phase fluids can present challenges to subterranean pumping systems.

BRIEF SUMMARY OF THE DISCLOSURE

Embodiments of intakes for downhole pumps are disclosed herein. In one exemplary embodiment, an intake for a downhole pump comprises an outer tubular member having a central axis. In addition, the intake comprises an inner tubular member disposed within the outer tubular member. The inner tubular member is radially spaced from the outer tubular member to form an outer annular flow path radially positioned between the inner tubular member and the outer tubular member. Further, the intake comprises a central shaft rotatably disposed within the inner tubular member. The central shaft is radially spaced from the inner tubular member to form an inner annular flow path radially positioned between the central shaft and the inner tubular member. Still further, the intake comprises a plurality of inlet apertures extending radially through the outer tubular member and in fluid communication with the outer annular flow path. Each of the plurality of inlet apertures has a circumferential width W that is between 5% and 50% of a total circumference of the outer tubular member.

Embodiments of downhole production systems are disclosed herein. In one exemplary embodiment, a downhole production system comprises a tubular string. In addition, the downhole production system comprises a pump coupled to the tubular string. Further, the downhole production system comprises an intake coupled to the pump. The intake is configured to receive fluid from a subterranean wellbore and route the fluid to the pump. The intake comprises an outer tubular member having a central axis. The intake also comprises an inner tubular member disposed within the outer tubular member. An outer annular flow path is radially disposed between the outer tubular member and the inner tubular member. The intake further comprises a central shaft rotatably disposed within the inner tubular member. An inner annular flow path is radially disposed between the inner tubular member and the central shaft. Still further, the intake comprises a plurality of inlet apertures extending radially through the outer tubular member to the outer annular flow path. Each inlet aperture includes an axial length L, a circumferential width W, and a length-to-width ratio of the axial length L to the circumferential width W. The length-to-width ratio of each inlet aperture is between 2.5 and 10.0.

Embodiments of intakes for downhole pumps are disclosed herein. In one exemplary embodiment, an intake for a downhole pump comprises an outer tubular member having a central axis, a first end, and a second end opposite the first end. In addition, the intake comprises an inner tubular member having a first end and a second end opposite the first end of the inner tubular member. The inner tubular member is coaxially disposed within the outer tubular member with the first end of the inner tubular member proximal the first end of the outer tubular member and distal the second end of the outer tubular member. Further, the intake comprises an outer annular flow path radially positioned between the outer tubular member and the inner tubular member. Still further, the intake comprises a central shaft coaxially disposed within the inner tubular member. The central shaft is configured to rotate relative to the outer tubular member and the inner tubular member. The intake also comprises an inner annular flow path radially positioned between the inner tubular member and the central shaft. The outer annular flow path and the inner annular flow path are in fluid communication at the second end of the inner tubular member. Moreover, the intake comprises a plurality of inlet apertures extending radially through the outer tubular member into the outer annular flow path. The plurality of inlet apertures are disposed more proximate the first end of the outer tubular member than the second end of the outer tubular member. The plurality of inlet apertures are arranged in a plurality of axially spaced rows such that each of the plurality of inlet apertures is circumferentially misaligned with each of the other inlet apertures about the central axis. Each inlet aperture includes an axial length L, a circumferential width W, and a length-to-width ratio of the axial length L to the circumferential width W that is between 2.5 and 10.0.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION OF EXEMPLARY EMBODIMENTS

Figure 1:
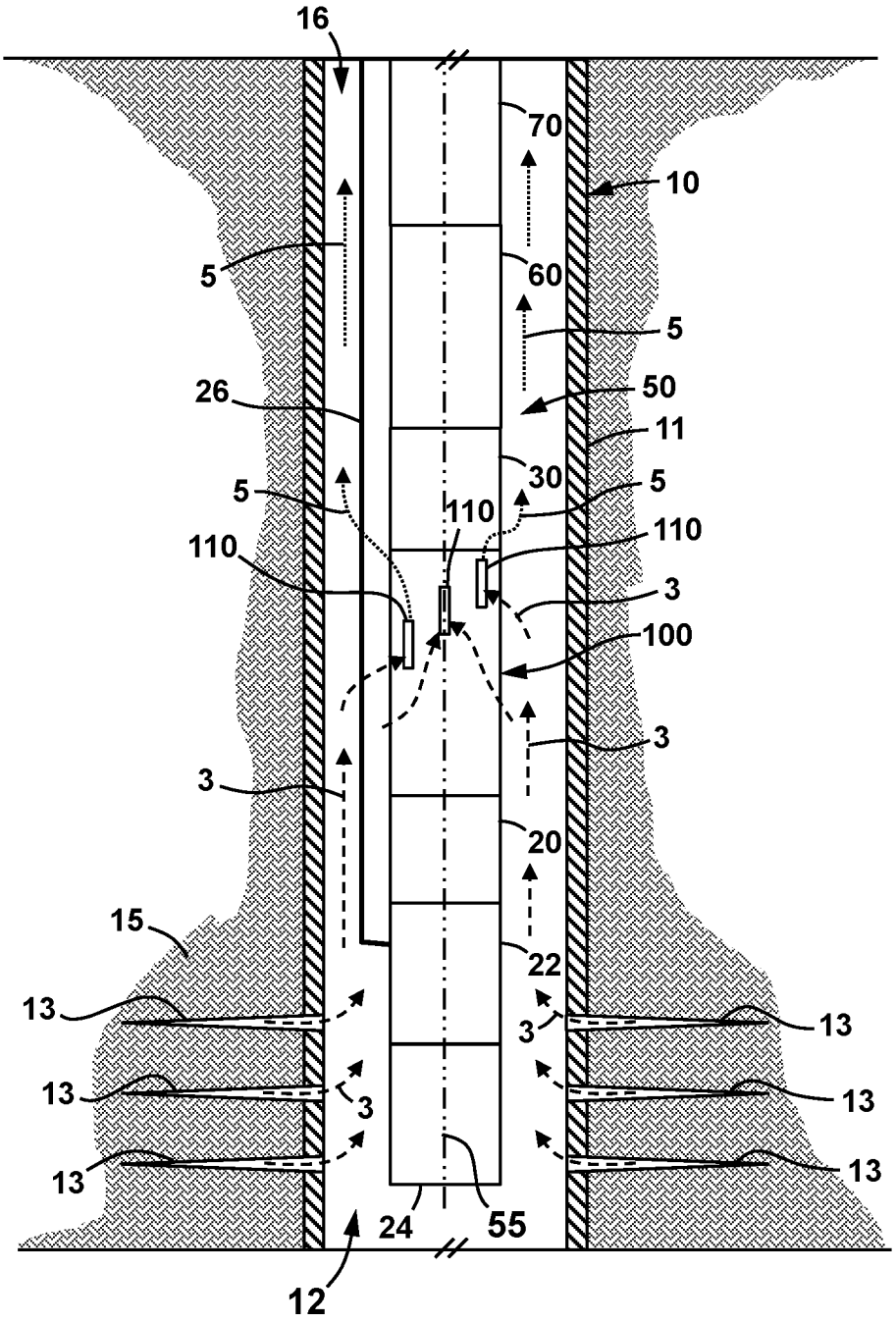
FIG. 1 is a schematic partial cross-sectional side view of an embodiment of a production system in accordance with principles disclosed herein for producing fluids from a subterranean wellbore.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a particular axis (e.g., central axis of a body or a port), while the terms "radial" and "radially" generally mean perpendicular to a particular axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," "generally," and the like mean within 10% (i.e., plus or minus 10%) of the recited value. Thus, for example, a recited angle of "about 80 degrees" refers to an angle ranging from 72 degrees to 88 degrees. Unless expressly stated otherwise, numerical ranges include the recited end points of the range as well as all points between the recited end points. Thus, for example, recited ranges of "about 10.0 to 20.0," "from 10.0 to 20.0," and "between 10.0 and 20.0" include end points 10.0 and 20.0, as well as all points therebetween.

As previously described, fluids produced from a subterranean formations often include both liquid and gas phases. Due to the presence of both liquids and gases, downhole pumps installed within the wellbore to lift the formation fluids to the surface can experience inefficiencies and even failures during operations. For example, in some instances, the pump may experience "gas lock," which may occur when gas accumulates in a pumping section of the installed pump system. The accumulated gas (which may form a gas bubble) forms a blockage that interrupts the flow of liquids across the impeller of the pump. Interruption of liquid flow across the pump may result in a rapid increase in temperature of the pump, which may lead to damage or failure. Thus, it is desirable to separate the gases and liquids in the formation fluids prior to routing them to the pump inlet (e.g., upstream of the pump inlet). Embodiments disclosed herein are directed to production systems for installation in a subterranean wellbore that include pump intakes that facilitate gravity-based separation of all, most, or at least some of the gases from the liquids of the fluids produced from subterranean formations. Thus, through use of embodiments of the intakes disclosed herein, the damage and failures associated with gas lock of the associated downhole pumps may be avoided or at least reduced.

Referring now to FIG. 1, a wellbore 10 extends into a subterranean formation 15 to provide access to hydrocarbon fluids (e.g., oil, natural gas, etc.) contained within a reservoir in formation 15. Wellbore 10 includes a casing 11 secured within formation 15 (e.g., with cement). Casing 11 defines a central throughbore or flow path 12 therein that extends from the surface (not shown). A plurality of perforations 13 extend through casing 11 into formation 15 to provide a plurality of flows paths for formation fluids (e.g., oil, natural gas, water, etc.) disposed within formation 15 to flow into throughbore 12.

A production system or assembly 50 is disposed within throughbore 12, thereby defining an annulus or annular region 16 radially positioned between production assembly 50 and casing 11. Production assembly 50 includes a central or longitudinal axis 55 generally aligned with the central axis of casing 11 during operations (e.g., production assembly 50 is coaxially disposed within casing 11). Moving axially downward, in this embodiment, production assembly 50 includes a downhole pump 60, a gas separator 30, an intake 100, a seal 20, a motor 22, and a downhole sensor assembly 24. Pump 60 may be an electrically drive submersible pump, in which case, production assembly 50 may be referred to as an electric submersible pump (ESP) assembly or system.

In this embodiment, pump 60 is axially uphole of each of separator 30, intake 100, seal 20, motor 22, and sensor assembly 24. In addition, in this embodiment, gas separator 30 is immediately axially adjacent and downhole of pump 60, intake 100 is immediately axially adjacent and downhole of separator 30, seal 20 is immediately axially adjacent and downhole of intake 100, motor 22 is immediately axially adjacent and downhole of seal 20, and downhole sensor assembly 24 is immediately axially adjacent and downhole of motor 22. However, it should be appreciated that the specific order and/or arrangement of the components (e.g., pump 60, separator 30, intake 100, seal 20, motor 22, sensor assembly 24, etc.) of production assembly 50 may be greatly varied. In addition, it should also be appreciated that the makeup of production assembly 50 may be varied in other embodiments. For example, in some embodiments, production assembly 50 may include one or more additional pumps (e.g., pump 60), motors (e.g., motor 22), or combinations thereof. As another example, in some embodiments, production assembly 50 may not include seal 20, separator 30, downhole sensor assembly 24, or combinations thereof.

The various components of production assembly 50 (e.g., pump 60, separator 30, intake 100, seal 20, motor 22, sensor assembly 24, etc.) are supported and suspended within casing 11 by a tubular string 70 extending from the surface. Tubular string 70 defines a fluid flow path separate from the annulus 16 between casing 11 and string 70 that communicates with the surface. In general, tubular string 70 may comprise coiled tubing, braided line, threadably attached or flanged rigid tubulars, and/or any other suitable tubular member(s).

Separator 30 may be any suitable type of separator known in the art for separating liquid and gas phases of a mixed phase fluid. For example, in some embodiments, separator is a rotary gas separator. Seal 20 may comprise any suitable seal, sealing device, or seal assembly known in the art for preventing fluids from migrating from intake 100 into motor 22 during operations. Motor 22 may comprise any suitable motor or driver known in the art for providing power (e.g., rotary power) to drive pump 60 during operations. For example, in this embodiment, motor 22 comprises an electric motor that is energized by electric power delivered by a cable 26 extending from the surface. Downhole sensor assembly 24 may comprise any suitable arrangement or assembly known in the art for housing one or more sensors used to detect and/or measure various parameters of production assembly 50 and wellbore 10. For example, in some embodiments, downhole sensor assembly 24 may include one or more sensors to detect and measure bottom hole pressure, bottom hole temperature, motor temperature, vibration, pump discharge pressure, etc.

In this embodiment, the formation fluids 3 entering throughbore 12 via perforations 13 include, among other things, gases (e.g., natural gas, carbon monoxide, hydrogen sulfide, air, carbon dioxide, etc.) and liquids (e.g., liquid oil, water, condensate, etc.). Because the gases within the formation fluids 3 can cause inefficiencies or even failures of pump 60 as described above (e.g., due to gas locking of pump 60), it is advantageous to separate the gases and liquids in the formation fluids 3 so that only or mostly the liquid phase of the formation fluids 3 is routed to the pump 60. Therefore, during pumping operations, intake 100 at least partially separates the liquid and gas phases of the formation fluids 3 migrating into casing 11 via perforations 13. In particular, during production operations, formation fluids 3 pass through perforations 13 into casing 11 and then flow uphole through annulus 16 to intake 100. As production fluids flow into annulus 16, motor 22 is actuated via electrical power supplied by cable 26 extending to the surface to drive pump 60 and draw formation fluids 3 from annulus 16 into intake 100 via a plurality of intake apertures 110. The mixed phase formation fluids 3 flow through intake 100 where they are separated (at least partially) into gas and liquid phases. Thereafter, the separated liquid phase (or substantially liquid phase) flows to gas separator 30 where any gas remaining in the separated liquid phase is further separated out of the liquid phase. Finally, the liquid phase of formation fluid 3 flows to pump 60 where it is pressurized and pumped to the surface via tubular string 70. The separated gas phase 5 of the formation fluid 3 (e.g., the gases separated out of fluid 3 in both intake 100 and separator 30) is emitted back into annulus 16 (e.g., via inlet apertures 110) and flows uphole to the surface through annulus 16.

In the manner described, during production operations, intake 100 separates the liquid and gaseous phases in the formation fluids 3 prior to any further separating of the liquid and gaseous phases by gas separator 30. Thus, intake 100 performs an initial separation of the liquid and gas phases of formation fluids 3. Accordingly, intake 100 may also be referred to herein as a "separator." As previously described, in some embodiments gas separator 30 may not be included within production assembly 50. Consequently, in such embodiments, intake 100 performs substantially all of the liquid and gas separation for formation fluid 3 prior to routing the separated liquid phase of formation fluid 3 to pump 60 as described above. The details regarding the structure (e.g., internal and external) of intake 100 are described in more detail below.

Figure 2:
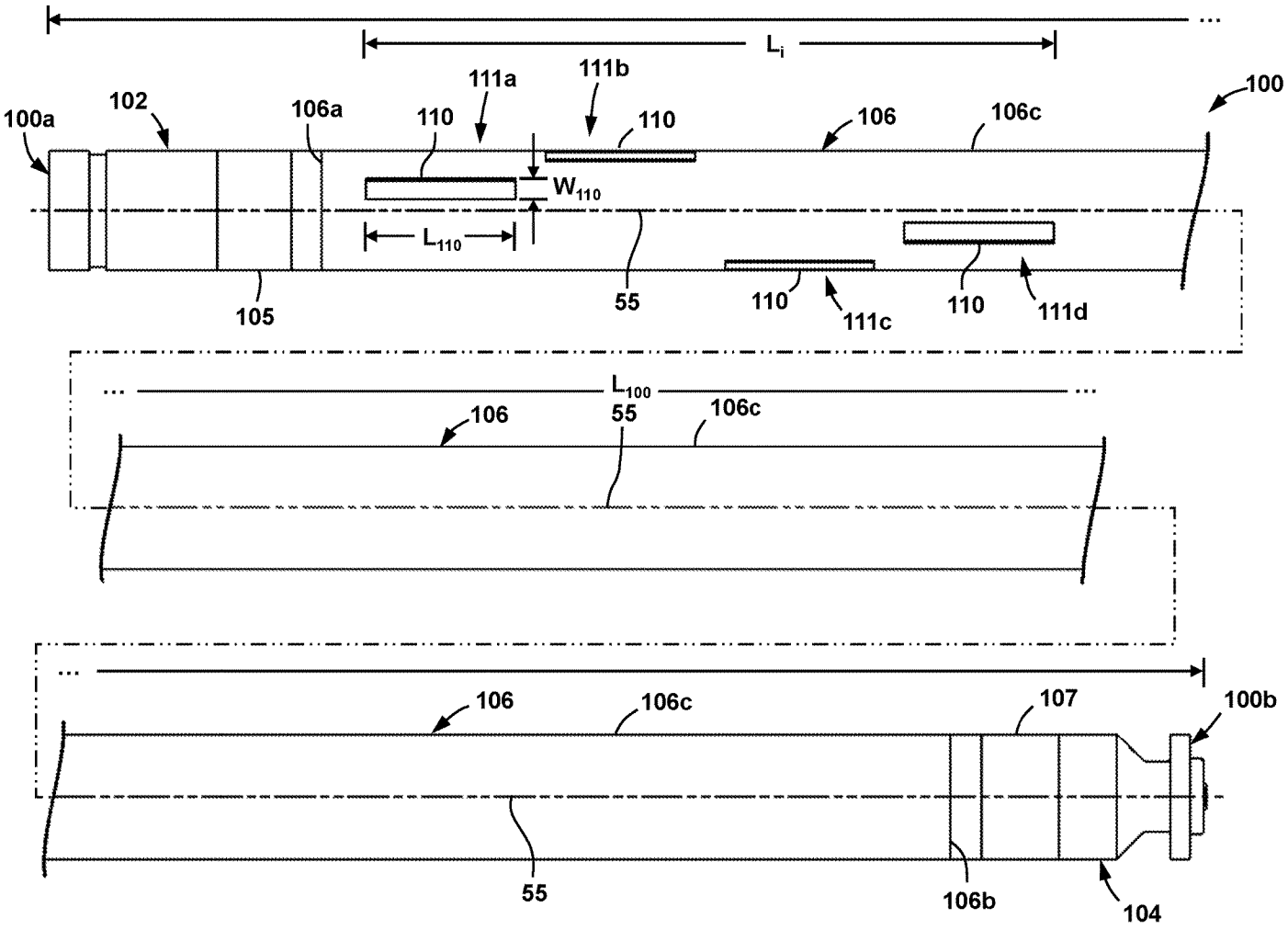
FIG. 2 is a side view of the intake of FIG. 1.
Figure 3:
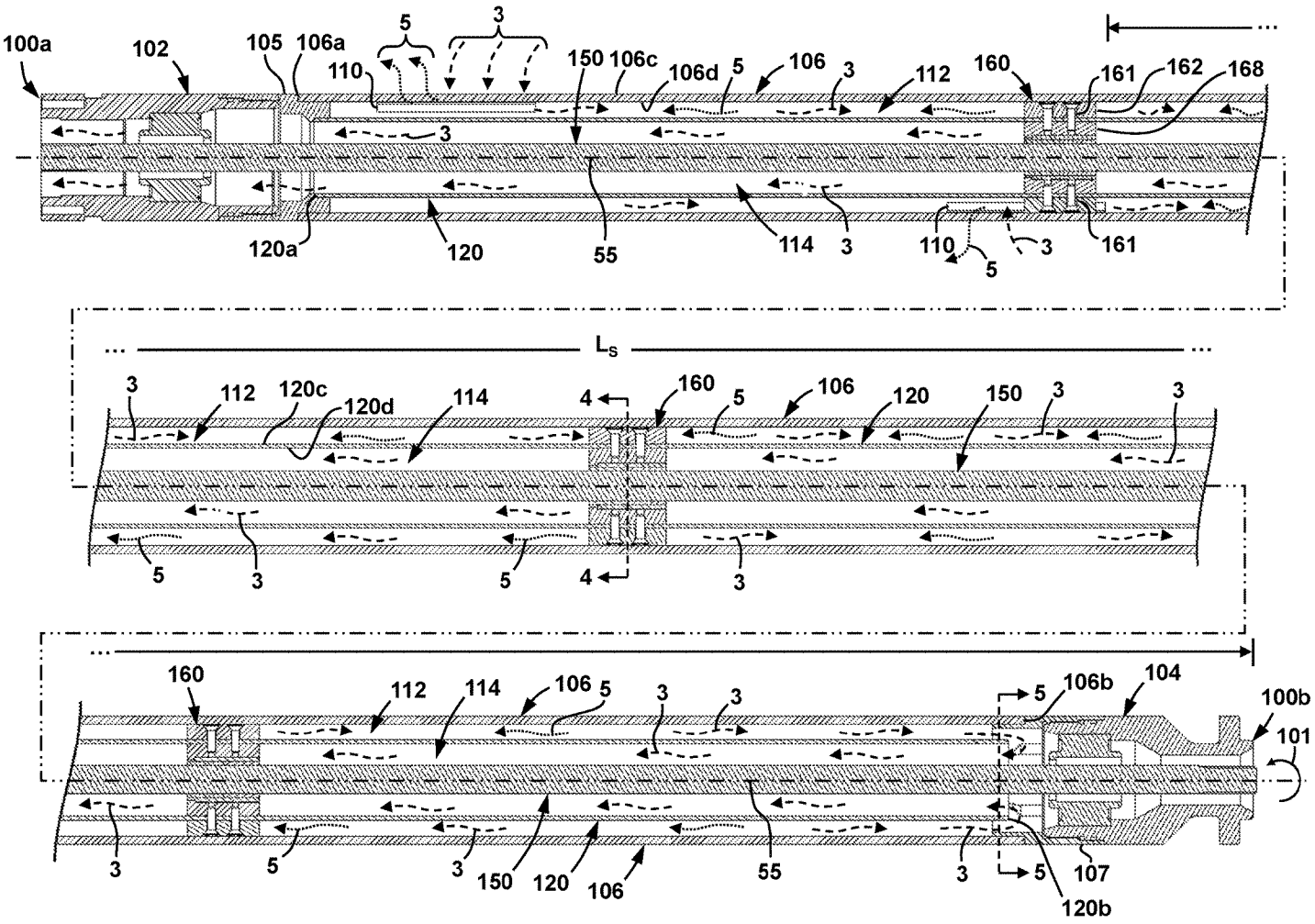
FIG. 3 is a cross-sectional side view of the intake of FIG. 2.

Referring now to FIGS. 2 and 3, intake 100 has a central axis coincident with axis 55 and includes a first or upper end 100*a*, a second or lower end 100*b* opposite upper end 100*a*, a first or upper connector 102 at upper end 100*a*, and a second or lower connector 104 at lower end 100*b*. In addition, intake 100 includes an outer tubular member 106, a first or upper adapter 105, and a second or lower adapter 107. Outer tubular member 106 is axially positioned between adapters 105, 107, upper adapter 105 extends axially from tubular member 106 to connector 102, and lower adapter 107 extends axially from tubular member 106 to connector 104. As best shown in FIG. 3, in this embodiment, upper adapter 105 is threadably attached to upper connector 102 and tubular member 106, and lower adapter 107 is threadably attached to tubular member 106 and lower connector 104.

Upper and lower connectors 102, 104 are couple intake 100 to axially adjacent components within production assembly 50 (see FIG. 1). As a result, upper and lower connectors 102, 104, respectively, may include one or more connection features (e.g., threads, flanges, etc.) to facilitate the connections with adjacent components of production assembly 50. As best shown in FIG. 1, in this embodiment, upper connector 102 is connected to pump 60 and lower connector 104 is connected to seal 20 during operations.

Referring again to FIGS. 2 and 3, outer tubular member 106 includes a first or upper end 106*a*, a second or lower end 106*b* opposite upper end 106*a*, a radially outer cylindrical surface 106*c* extending axially from end 106*a* to end 106*b*, and a radially inner cylindrical surface 106*d* extending axially from end 106*a* to end 106*b*. Upper end 106*a* is threadably attached to upper adapter 105 and lower end 106*b* is threadably attached to lower adapter 107.

Referring now to FIG. 3, intake 100 also includes an inner tubular member 120 coaxially disposed within outer tubular member 106. Inner tubular member 120 includes a first or upper end 120*a*, a second or lower end 120*b* opposite upper end 120*a*, a radially outer cylindrical surface 120*c* extending axially from end 120*a* to end 120*b*, and a radially inner cylindrical surface 120*d* extending axially from end 120*a* to end 120*b*. Upper end 120*a* is proximal upper end 106*a* of outer tubular member 106, and lower end 120*b* is proximal lower end 106*b* of outer tubular member 106. Inner tubular member 120 has an outer diameter that is less than the inner diameter of outer tubular member 106, and thus, an annulus or annular flow path 112 is radially disposed between tubular members 106, 120. Annular flow path 112 extends axially from upper ends 120*a*, 106*a* to lower ends 106*b*, 120*b*. Upper end 120*a* of inner tubular member 120 is threadably attached to upper adapter 105 and lower end 120*b* is engaged with and radially supported by a connection profile (discussed below) within lower adapter 107.

Referring still to FIG. 3, a central shaft 150 extends axially through intake 100. In particular, central shaft 150 extends axially through upper connector 102, upper adapter 105, inner tubular member 120, lower adapter 107, and lower connector 104. An annulus or annular flow path 114 is radially disposed between shaft 150 and inner tubular member 120. In this embodiment, central shaft 150 is operatively coupled (e.g., either directly or indirectly) to motor 22 and pump 60 (e.g., shaft 150 may be coupled either directly or indirectly to other shafts rotatably disposed within pump 60 and motor 22). During operations, central shaft 150 is driven by motor 22 to rotate in direction 101, which in turn drives pump 60 (e.g., drives rotation of one or more impellers within pump 60). However, it should be appreciated that in some embodiments motor 22 may drive shaft 150 to rotate in a direction opposite direction 101. As one having ordinary skill in the art will appreciate, the choice of the rotational direction of shaft 150 is typically driven by the design of pump 60. Central shaft 150 may also be coupled (e.g., directly or indirectly) to other components disposed within production system 50 (e.g., at one or both of the ends of driveshaft 150) so that the operation of motor 22 may further cause actuation of those other components as well via central shaft 150.

Referring now to FIG. 2, each of the plurality of inlet apertures 110 are disposed along outer tubular member 106 in a region or position more proximate upper end 106*a* than lower end 106*b*. In this particular embodiment, all of the inlet apertures 110 are disposed on the upper half (or uphole half) of outer tubular member 106. In addition, apertures 110 are arranged in a plurality of axially spaced, circumferentially oriented rows. For example, in this embodiment, apertures 110 are arranged in four axially-spaced rows 111*a*, 111*b*, 111*c*, 111*d*; each row 111*a*, 111*b*, 111*c*, 111*d* including two circumferentially-spaced apertures 110 therein. Although each row 111*a*, 111*b*, 111*c*, 111*d* includes two apertures 110 in this embodiment, in other embodiments, each row (e.g., each row 111*a*, 111*b*, 111*c*, 111*d*) may include one or more apertures (e.g., apertures 110). For example, in some embodiments, intake apertures 110 are arranged in eight axially spaced, circumferentially oriented rows with one aperture 110 in each row, and with each aperture 110 being circumferentially-spaced approximately 45° from the aperture(s) 110 in each of the immediately axially adjacent row(s). In the embodiment shown in FIGS. 2 and 3, each row 111*a*, 111*b*, 111*c*. 111*d* includes two apertures 110 that radially oppose one another about axis 55 (i.e., for each row 111*a*, 111*b*, 111*c*, 111*d*, there are two apertures 110 circumferentially-spaced approximately 180° apart). In addition, it should be appreciated that in this embodiment each aperture 110 is circumferentially or angularly spaced from each of the other apertures 110 such that none of the apertures 110 are circumferentially or angularly aligned along outer tubular member 106 with respect to axis 55. In other words, apertures 110 are circumferentially misaligned with one another such that none of the apertures 110 are disposed directly axially above or below any of the other apertures 110. In this embodiment, each aperture 110 is circumferentially or angularly spaced approximately 45° from each of the immediately circumferentially adjacent aperture(s) 110. However, it should be appreciated that in some embodiments, apertures 110 are not circumferentially or angularly misaligned such that at least some of the apertures are disposed axially above or below others of the apertures 110.

In some embodiments, apertures 110 are arranged in rows (e.g., rows 111*a*, 111*b*, 111*c*, 111*d*) such that apertures 110 are generally evenly circumferentially-spaced about axis 55 (e.g., such as the embodiment of FIGS. 2 and 3). However, in other embodiments, apertures 110 may not be evenly or uniformly circumferentially-spaced about axis 55. Regardless of whether apertures 110 are evenly or not evenly circumferentially-spaced about axis 55, in some embodiments, it is desirable to space apertures 110 about the entire circumference of outer tubular member 120. Without being limited to this or any other theory, the complete (or nearly complete) coverage for inlet apertures 110 about the circumference of outer tubular member 120 of intake 100 allows fluid flowing through all circumferential portions or regions of annulus 16 to communicate with at least one of the inlet apertures 110 during production operations.

In this embodiment, each aperture 110 is shaped as an elongate, axially extending, rectangular slot having an axial length (measured parallel to axis 55) that is greater than its width (measured circumferentially about outer tubular member 106). However, it should be appreciated that apertures 110 may have other shapes in other embodiments. For example, in other embodiments, apertures 110 are formed as ovals (e.g., ovals or ellipses elongated in a direction parallel with axis 55), squares, circles, triangular, zig-zags, curved/arcuate holes, etc. As shown in FIG. 2, each inlet aperture 110 includes an axial length $L_{110}$ and a circumferential width $W_{110}$. In this embodiment the ratio of length $L_{110}$ to width $W_{110}$ (i.e., $L_{110}/W_{110}$) for each aperture 110 is between about 2.5 and 10.0, preferably between about 5.0 and 8.0, and more preferably equal to about 6.67. Without being limited to this or any other theory, the exemplary length-to-width ratios above provide an optimum size for inlet aperture 110 so that formation fluids (e.g., formation fluid 3 shown in FIG. 1) may flow into intake 100 from annulus 16 via apertures 110 without substantially disrupting or impeding the flow of separated gases (e.g., gases 5 shown in FIG. 1) back into annulus 16 from intake 100 via apertures 110 and vice-versa. The performance of intake 100 is further enhanced when intake apertures 110 are spaced as described above (i.e., evenly circumferentially-spaced about axis 55 and/or spaced so that each aperture 110 is not circumferentially aligned with any of the other aperture 110).

In at least some embodiments, the circumferential width $W_{110}$ (or the widest circumferential width) of each aperture 110 is between 5% and 50% of the entire circumference of radially outer cylindrical surface 106*c* of outer tubular member 106. This may be true regardless of the particular shape of apertures 110 (e.g., rectangular, circular, elliptical, irregular, etc.). In this embodiment, the circumferential width $W_{110}$ of each inlet aperture 110 is approximately 12% of the entire circumference of radially outer cylindrical surface 106*c* of outer tubular member 106. Without being limited to this or any other theory, by placing the circumferential width $W_{110}$ of apertures 110 between 5% and 50% of the entire circumference of radially outer cylindrical surface 106*c*, there is a sufficient amount of tubular wall along outer tubular member 106 circumferentially adjacent apertures 110 to help create a "quiet" area within annular flow path 112 that is shielded from the turbulent flow within annulus 16. As will be described in more detail below, the creation of these so called "quiet" areas within annular flow path 112 further promotes separation of the gases (e.g., gases 5) from formation fluids 3 during operations. The formation of these quiet areas may also further be facilitated by the spacing and general arrangement of apertures 110 as discussed below.

As previously described, annulus 112 is radially disposed between tubular members 106, 120, and annulus 114 is radially disposed between shaft 150 and inner tubular member 120. The radial spacing between outer tubular member 106 and inner tubular member 120, and the radial spacing between inner tubular member 120 and central shaft 150 are maintained by a plurality of spacer assemblies 160 axially spaced from one another in a region axially between upper ends 106*a*, 120*a* and lower ends 106*b*, 120*b*.

Figure 4:
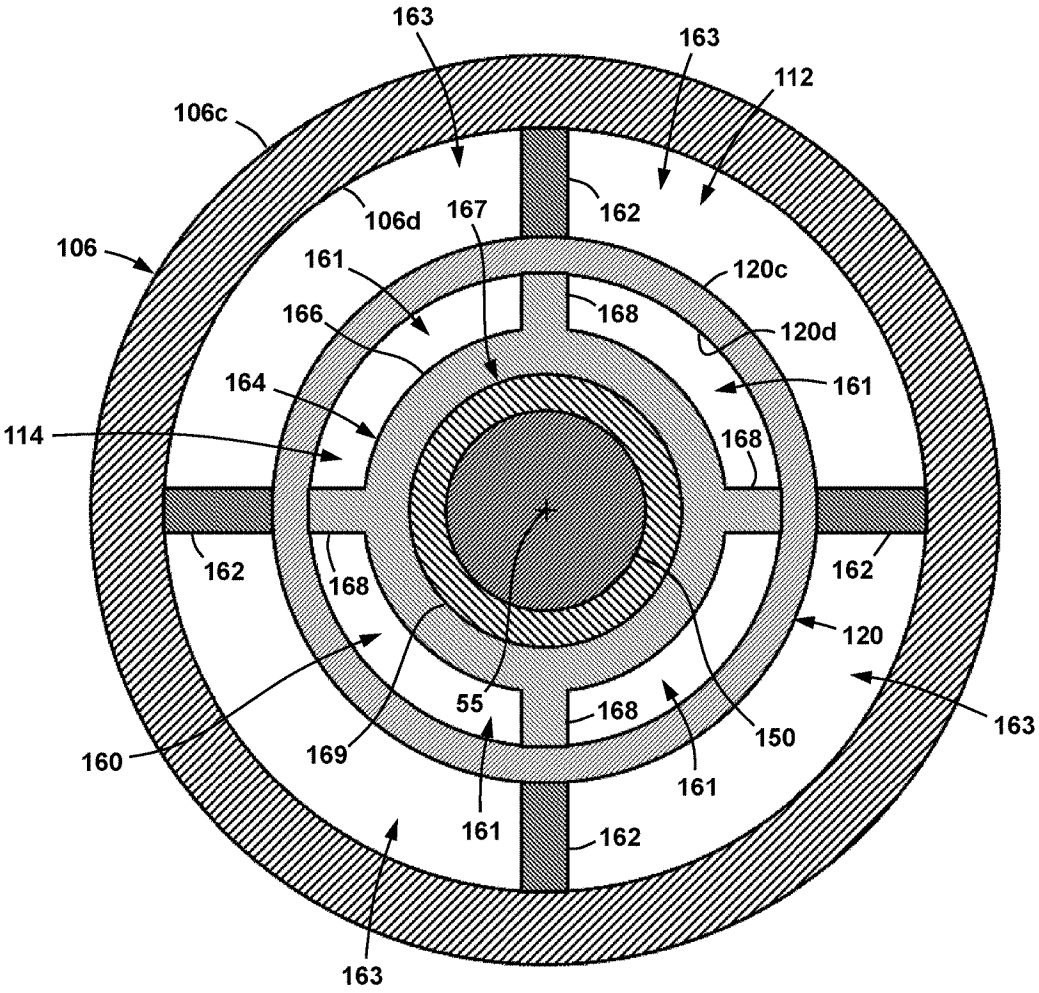
FIG. 4 is a cross-sectional view of the intake of FIG. 2 taken along section 4-4 in FIG. 3.

Referring now to FIG. 4, one spacer assembly 160 is shown, it being understood that each of the spacer assemblies 160 is the same. In this embodiment, each spacer assembly 160 includes a plurality of uniformly circumferentially-spaced outer spacers 162 radially positioned between tubular members 106, 120 and an inner spacer member 164 radially positioned between shaft 150 and inner tubular member 120. Inner spacer member 164 includes an annular hub 166 disposed about shaft 150 and a plurality of uniformly circumferentially-spaced inner spacers 168 extending radially from hub 166 to inner tubular member 120. Inner spacers 168 extend radially outward from hub 166 such that when hub 166 is coaxially disposed within inner tubular member 120, each of the inner spacers 168 engages inner surface 120*d* of inner tubular member 120 to center inner spacer member 164 relative to axis 55. In this embodiment, four outer spacers 162 are evenly circumferentially-spaced spaced 90° apart and four inner spacers 168 are evenly circumferentially-spaced 90° apart. However, it should be appreciated that the number and arrangement of inner spacers 168 may be varied in other embodiments (e.g., there may be more or less than four spacers 168 that may or may not be evenly circumferentially-spaced about axis 55 in other embodiments).

As shown in FIG. 3, a pair of securing members 161 (e.g., bolts, rivets, screws, pins, etc.) are inserted radially through each aligned pair of outer spacers 162 and inner spacers 168 to thereby secure each pair of the spacers 162, 168 both to one another and to inner tubular member 120. As a result, each of the securing members 161 extend radially through the wall of inner tubular member 120 (i.e., through cylindrical surfaces 120*c*, 120*d*).

An annular bearing 169 is radially positioned between and engages hub 166 and shaft 150. During operations, central shaft 150 is received through bearing 169 within throughbore 167 such that bearing 169 supports rotation of shaft 150 about axis 55 relative to spacer member 164, spacers 162, 168, and tubular members 106, 120. Bearing 169 is depicted only schematically in FIG. 4 as a matter of convenience; however, it should be appreciated that bearing 169 may, in some embodiments, include a pair of bearing races and one or more bearing elements (e.g., balls) to facilitate the relative rotation of central shaft 150 and inner spacer member 164. In other embodiments, bearing 169 may more simply comprise a bushing or cylindrical sleeve (i.e., bearing 169 may not include any relatively moving parts or components). Thus, bearing member 164 may comprise any suitable bearing known in the art for simultaneously supporting radial loads while allowing relative rotation between central shaft 150 and inner spacer member 164.

Referring again to FIG. 4, spacers 162, 168 maintain the radial spacing of tubular member 106, 120 and shaft 150, while simultaneously allowing fluid (e.g., formation fluid 3) to flow axially along annular flow paths 112, 114 across assemblies 160. Specifically, a plurality of inner flow ports or openings 161 are defined between each pair of circumferentially adjacent inner spacers 168, and a plurality of outer flow ports or openings 163 are defined between each pair of circumferentially adjacent outer spacers 162. Inner flow ports 161 allow fluid communication along annular flow path 114 axially across spacer assemblies 160, and outer flow ports 163 allow fluid communication along annular flow path 112 axially across spacer assemblies 160. Because spacers 162, 168 maintain radial spacing between tubular members 102, 120, and shaft 150 and help to support rotational movement of shaft 150, spacers 162, 168 may be referred to herein as "bearings."

Figure 5:
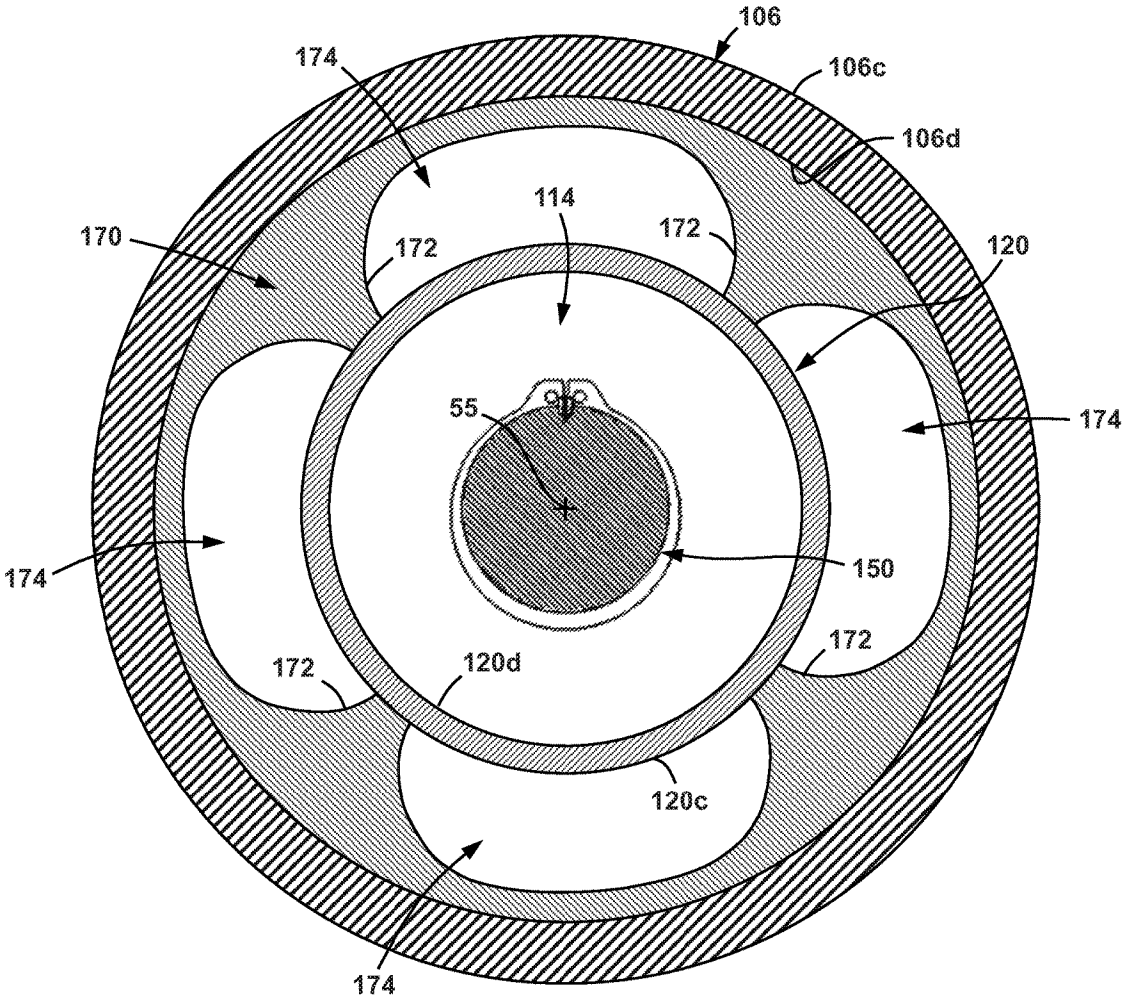
FIG. 5 is a cross-sectional view of the intake of FIG. 2 taken along section 5-5 in FIG. 3.

Referring now to FIG. 5, lower end 120*b* of inner tubular member 120 is radially supported by a lower support profile 170 disposed within lower adapter member 107. Support profile 170 includes a plurality uniformly circumferentially-spaced, radially extending engagement members 172. A plurality of flow ports or openings 174 are circumferentially disposed between each pair of adjacent engagement members 172. Flow ports 174 allow axial fluid flow along annular flow path 112 across support profile 170. In this embodiment, four engagement members 172 spaced 90° apart from one another about axis 55, and thus, there are four flow ports 174 spaced 90° apart from one another about axis 55.

Referring now to FIGS. 1-3, during production operations, formation fluids 3 flow into throughbore 12 of casing 11 via perforations 13 and then into inlet apertures 110 of intake 100 as previously described. Motor 22 is powered via electricity provided by cable 26 to drive rotation of central shaft 150 about axis 55 in direction 101 (FIG. 3) within intake 100. In some embodiments, lower end 100*b* of intake 100 is positioned vertically lower than upper end 100*a* of intake 100 such that the formation fluids 3 flow axially toward lower end 100*b* within annular flow path 112 upon entering at inlet apertures 110 under the force of gravity. In addition, the relatively lower pressure within annular flow passage 112 compared to the pressure within annulus 16 also facilitates the flow of fluid 3 into apertures 110, down annular flow passage 112 and toward inner annular flow passage 114. Due to differences in densities, the gases and liquids within formation fluids 3 separate within annular flow path 112 under the force of gravity so that the liquids continue to flow/fall toward lower end 100*b* while at least some of the gases 5 within formation fluid 3 migrate back upward toward upper end 100*a* and out apertures 110. As a result, apertures 110 function as an entrance point or inlet for formation fluids 3 (liquids and gases) and as an exit point or outlet for separated gases 5 during production operations.

Without being limited to this or any other theory, because inlet apertures 110 are arranged such that none of the apertures 110 are circumferentially aligned with one another with respect to axis 55, and because apertures 110 are sized to include the length-to-width ratios discussed above (i.e., $L_{110}/W_{110}$), the annular volume of liquid (e.g., the liquid of formation fluid 3) available to enter into intake 100 from annulus 16 is maximized. In addition, without being limited to this or any other theory, due at least in part to the sizing and arrangement of inlet apertures 110 described above, gas (e.g., gases 5) exiting intake 100 via inlet apertures 110 impart minimal resistance and/or interference for formation fluids 3 flowing into the intake 100 and flow path 112. More specifically, the relationship between aperture 110 size (e.g., $L_{110}/W_{110}$) and aperture 110 alignment (e.g., the arrangement of apertures 110 within rows 111*a*, 111*b*, 111*c*, 111*d*, discussed above) minimizes friction inhibiting either the entrance of formation fluid 3 into intake 100 (including both liquid and gas) through apertures 110 or the exiting of gas 5 into annulus 16 through apertures 110. In addition, without being limited to this or any other theory, the circumferential misalignment of apertures 110 over length $L_i$ helps to minimize the exposure of formation fluid 3 within annular flow passage 112 to the turbulent flow in annulus 16, thereby contributing to the creation of the "quiet areas" within annular flow path 112 as described above. As a result, gravity separation of the gas phase 5 of formation fluid 3 may occur in these relatively sheltered and "quiet" areas within annular flow passage 112, along the length of intake 100 carrying inlet apertures 110 (e.g., inlet length $L_i$ discussed supra). Additional gravity separation may then occur as the fluid 3 flows through annular flow passage below or downstream of inlet apertures 110 (e.g., sump length $L_s$ discussed supra). It should also be appreciated that the circumferential width $W_{110}$ of inlet apertures (e.g., a width $W_{110}$ being between and including 5% and 50% of the total circumference of outer tubular member 106) also contributes and/or facilitates the formation of the so-called quiet areas within annular flow path 112 as previously described.

Upon reaching the lower end 120*b* of inner housing member 120, the formation fluids 3 in annular flowpath 112, which include a reduced concentration of gas 5, pass through ports 174 in support profile 170 (see FIG. 5) and then flow upward in annular flow path 114 within inner tubular member 120. Upon exiting annular flow path 114 the formation fluids 3 are directed through upper end 100*a* of intake 100 and then and into gas separator 3 to further reduce the concentration or amount of gases 5 within fluids 3 prior to ultimately routing fluid into pump 60 (see FIG. 1). Thereafter, pump 60 pressurizes the now mostly (or possibly only) liquid formation fluid 3 and then further induces fluid 3 to flow to the surface through one or more defined flow paths (e.g., the at least one flow path defined with tubular string 70). During these operations, the formation fluids 3 and/or gases 5 flowing through annular flow paths 112, 114 are able to bypass spacer assemblies 160 via the flow ports 163, 161, respectively, disposed therein (see FIG. 4) as previously described.

In some embodiments most (if not all) of the gases 5 separate out of the formation fluids 3 as the formation fluids 3 flow axially downward within annular flow path 112 toward lower end 120*b* of inner tubular member, mostly (if not only) liquid advances into annular flow path 114 and then ultimately on to pump 60. In these embodiments, production assembly 50 may not include the additional gas separator 30 described above. However, in other embodiments, if the flow rate of formation fluid 3 through intake 100 and/or the gas concentration within the formation fluid 3 is high (i.e., above some threshold), some amount of gas 5 may flow through annular flow path 112 into inner annular flow path 114 and out through upper end 100*a*. In these embodiments, intake 100 at least reduces (potentially significantly) the amount or concentration of gases 5 flowing to pump 60. In addition, in these embodiments, the inclusion of the additional gas separator 30 further reduces the amount of gases 5 within formation fluid 3 (potentially removing all gases 5 in some instances); however, pre-separating out at least a portion of the gases 5 with intake 100 may help to increase the efficiency and overall performance of separator 30 during operations.

Regardless of whether intake 100 is operated with or without gas separator 30, through use of intake 100 the chances that gas 5 will accumulate at the inlet of pump 60 in sufficient amounts to cause gas lock of pump 60 is reduced. In addition, due to the relatively long length that the formation fluids 3 must travel to reach annular flow path 114, the lower portion (e.g., the portion extending axially from lower end 120*b* toward inlet apertures 110) of annular flow path 112 forms a sump for collecting liquids that will eventually flow into annular flow path 114 and pump 60. Without being limited to this or any other theory, the sump in annular flow path 112 creates a reservoir of liquid that helps ensure that the flow of liquid to pump 60 will not be totally interrupted or lost, even in the event that a large gas bubble is advanced into annular flow path 112. Therefore, intake 100 may also improve the performance and longevity of pump 60 in formations that produce substantially slugged flow (i.e., the formation produces fluids in alternating slugs of liquid and gas). As shown in FIG. 2, intake 100 includes a total length $L_{100}$ measured axially between ends 100*a*, 100*b*. In addition, the length of intake 100 that corresponds with inlet apertures 110 is shown as an inlet length $L_i$ in FIG. 2. Further, the length of intake 100 that corresponds with the sump (i.e., the length from the axially lower end of the axially lowest aperture 110 to the lower end 100*b* of intake 100) is shown as a sump length $L_s$ in FIG. 3. In this embodiment, the inlet length $L_i$ is approximately between 25% and 75% of the total length $L_{100}$, and the sump length $L_s$ is approximately between 25% and 75% of the total length $L_{100}$.

In the manner described, through use of an intake (e.g., intake 100), in accordance with the embodiments disclosed herein, upstream of a pump (e.g., pump 60) in a production assembly 50 disposed within a subterranean wellbore, failures resulting from flowing gases to the pump may be avoided or at least reduced. Accordingly, through use of intake in accordance with the embodiments herein, the operational life of such pumps may be increased, which thereby reduces the overall costs for producing hydrocarbons from a subterranean well via such an artificial lift system.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. An intake for a downhole pump, the intake comprising:

an outer tubular member having a central axis:

an inner tubular member disposed within the outer tubular member, wherein the inner tubular member is radially spaced from the outer tubular member to form an outer annular flow path radially positioned between the inner tubular member and the outer tubular member;

a central shaft rotatably disposed within the inner tubular member, wherein the central shaft is radially spaced from the inner tubular member to form an inner annular flow path radially positioned between the central shaft and the inner tubular member;

a plurality of inlet apertures extending radially through the outer tubular member and in fluid communication with the outer annular flow path, wherein each of the plurality of inlet apertures has a circumferential width W that is between 5% and 50% of a total circumference of the outer tubular member;

wherein the outer tubular member includes a first end and a second end opposite the first end of the outer tubular member;

wherein the inner tubular member includes a first end and a second end opposite the first end of the inner tubular member;

wherein the first end of the outer tubular member is proximal the first end of the inner tubular member and distal the second end of the inner tubular member;

wherein the second end of the outer tubular member is proximal the second end of the inner tubular member and distal the first end of the inner tubular member;

wherein the plurality of inlet apertures are disposed more proximate the first end of the outer tubular member than the second end of the outer tubular member; and wherein the outer annular flow path and the inner annular flow path are in fluid communication at the second end of the inner tubular member.

2. The intake of claim 1, wherein the plurality of inlet apertures are arranged in a plurality of axially spaced rows, wherein each of the plurality of inlet apertures is circumferentially misaligned with each of the other inlet apertures about the central axis.

3. The intake of claim 2, wherein the outer tubular member has a first end and a second end axially opposite the first end, and wherein the plurality of inlet apertures are more proximate the first end than the second end.

4. The intake of claim 3, wherein each axially spaced row includes a pair of inlet apertures, and wherein each inlet aperture is circumferentially-spaced about 45° about the central axis from each circumferentially adjacent inlet aperture.

5. The intake of claim 1, further comprising a first connector coupled to a first end of the outer tubular member and to a first end of the inner tubular member, wherein the central shaft extends axially through the first connecting member.

6. The intake of claim 1, wherein each of the plurality of inlet apertures has an axial length L, and wherein a length-to-width ratio of the axial length L to the circumferential width W of each inlet aperture is between 2.5 and 10.0.

7. The intake of claim 6, wherein the length-to-width ratio of each inlet aperture is equal to about 6.67.

8. The intake of claim 1, wherein the intake has a total length measured axially from an uphole end of the intake to a downhole end of the intake, wherein an axial length of the intake spanned by the plurality of inlet apertures is between 25 and 75% of the total length of the intake.

9. A downhole production system, comprising:

a tubular string;

a pump coupled to the tubular string; and an intake coupled to the pump, wherein the intake is configured to receive fluid from a subterranean wellbore and route the fluid to the pump;

wherein the intake comprises:

an outer tubular member having a central axis;

an inner tubular member disposed within the outer tubular member, wherein an outer annular flow path is radially disposed between the outer tubular member and the inner tubular member;

a central shaft rotatable disposed within the inner tubular member, wherein an inner annular flow oath is radially disposed between the inner tubular member and the central shaft;

a plurality of inlet apertures extending radially through the outer tubular member to the outer annular flow path, wherein each inlet aperture includes an axial length L, a circumferential width W, and a length-to-width ratio of the axial length L to the circumferential width W, wherein the length-to-width ratio of each inlet aperture is between 2.5 and 10.0;

wherein the outer tubular member includes a first end and a second end opposite the first end of the outer tubular member;

wherein the inner tubular member includes a first end and a second end opposite the first end of the inner tubular member;

wherein the first end of the outer tubular member is proximal the first end of the inner tubular member and distal the second end of the inner tubular member;

wherein the second end of the outer tubular member is proximal the second end of the inner tubular member and distal the first end of the inner tubular member;

wherein the plurality of inlet apertures are disposed more proximate the first end of the outer tubular member than the second end of the outer tubular member; and wherein the outer annular flow path and the inner annular flow path are in fluid communication with one another at the second end of the inner tubular member.

10. The downhole production system of claim 9, wherein the central shaft is operatively coupled to the pump and configured to drive the pump.

11. The downhole production system of claim 10, wherein each of the plurality of inlet apertures is circumferentially misaligned with each of the other inlet apertures about the central axis.

12. The downhole production system of claim 11, wherein the plurality of inlet apertures is arranged in a plurality of axially spaced rows, wherein each axially spaced row includes a pair of inlet apertures, and wherein each inlet aperture is circumferentially-spaced approximately 45° from each of the circumferentially adjacent inlet apertures in the same row.

13. The downhole production system of claim 9, further comprising a first connecting member coupled to a first end of the outer tubular member, a first end of the inner tubular member and the pump, wherein the central shaft extends axially through the first connecting member.

14. The downhole production system of claim 9, wherein the length-to-width ratio of each inlet aperture is equal to about 6.67.

15. The downhole production system of claim 9, wherein a length of the intake occupied by the plurality of inlet apertures is between 25 and 75% of a total length of the intake.

16. The downhole production system of claim 9, wherein the circumferential width W of each inlet aperture is between 5% and 50% of a total circumference of the outer tubular member.

17. An intake for a downhole pump, the intake comprising:

an outer tubular member having a central axis, a first end, and a second end opposite the first end;

an inner tubular member having a first end and a second end opposite the first end of the inner tubular member;

wherein the inner tubular member is coaxially disposed within the outer tubular member with the first end of the inner tubular member proximal the first end of the outer tubular member and distal the second end of the outer tubular member, and with the second end of the inner tubular member proximal the second end of the outer tubular member and distal the first end of the outer tubular member;

an outer annular flow path radially positioned between the outer tubular member and the inner tubular member;

a central shaft coaxially disposed within the inner tubular member, wherein the central shaft is configured to rotate relative to the outer tubular member and the inner tubular member;

an inner annular flow path radially positioned between the inner tubular member and the central shaft, wherein the outer annular flow path and the inner annular flow path are in fluid communication at the second end of the inner tubular member;

a plurality of inlet apertures extending radially through the outer tubular member into the outer annular flow path, wherein the plurality of inlet apertures are disposed more proximate the first end of the outer tubular member than the second end of the outer tubular member;

wherein the plurality of inlet apertures are arranged in a plurality of axially spaced rows such that each of the plurality of inlet apertures is circumferentially misaligned with each of the other inlet apertures about the central axis; and wherein each inlet aperture includes an axial length L, a circumferential width W, and a length-to-width ratio of the axial length L to the circumferential width W that is between 2.5 and 10.0.

18. The intake of claim 17, wherein the circumferential width W of each inlet aperture is equal to approximately 12% of a total circumference of the outer tubular member.

* * * * *